US005809928A

United States Patent [19]

Cox

[11] Patent Number: 5,809,928

[45] Date of Patent: Sep. 22, 1998

[54] ADJUSTABLE BOAT FLOOR INSERT

[76] Inventor: Donald E. Cox, PO Box 651, West Branch, Iowa 52358

[21] Appl. No.: 883,588

[22] Filed: Jun. 26, 1997

[51] Int. Cl.[6] ..... B63B 8/00

[52] U.S. Cl. ..... 114/343; 144/364

[58] Field of Search ..... 114/343, 351, 114/352, 353, 354, 355, 361, 362, 363, 364, 345

[56] References Cited

U.S. PATENT DOCUMENTS

| | | | |
|---|---|---|---|
| 3,566,425 | 3/1971 | Welty | 114/345 |
| 4,807,555 | 2/1989 | Hart | 114/354 |
| 5,105,756 | 4/1992 | Bell | 114/343 |
| 5,170,741 | 12/1992 | Magers et al. | 114/364 |
| 5,299,721 | 4/1994 | Cummings | 114/345 |
| 5,546,885 | 8/1996 | Porada | 114/345 |
| 5,601,461 | 2/1997 | Mills | 114/345 |

*Primary Examiner*—Stephen Avila

[57] ABSTRACT

A new Adjustable Boat Floor Insert for providing a level flooring surface for boats with a ribbed bottom. The inventive device includes a first floorboard member and a second floorboard member that is removably inserted into the first floorboard member.

14 Claims, 3 Drawing Sheets

ADJUSTABLE BOAT FLOOR INSERT

BACKGROUND OF THE INVENTION

1. Field of the Invention

The present invention relates to boat flooring devices and more particularly pertains to a new Adjustable Boat Floor Insert for providing a level flooring surface for boats with a ribbed bottom.

2. Description of the Prior Art

The use of boat flooring devices is known in the prior art. More specifically, boat flooring devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art boat flooring devices include U.S. Pat. No. 5,170,741; U.S. Pat. No. 5,265,555; U.S. Pat. No. 4,807,555; U.S. Pat. No. 4,827,864; U.S. Pat. No. 5,063,870 and U.S. Pat. No. 5,105,756.

While these devices fulfill their respective, particular objectives and requirements, the aforementioned patents do not disclose a new Adjustable Boat Floor Insert. The inventive device includes a first floorboard member and a second floorboard member that is removably inserted into the first floorboard member.

In these respects, the Adjustable Boat Floor Insert according to the present invention substantially departs from the conventional concepts and designs of the prior art, and in so doing provides an apparatus primarily developed for the purpose of providing a level flooring surface for boats with a ribbed bottom.

SUMMARY OF THE INVENTION

In view of the foregoing disadvantages inherent in the known types of boat flooring devices now present in the prior art, the present invention provides a new Adjustable Boat Floor Insert construction wherein the same can be utilized for providing a level flooring surface for boats with a ribbed bottom.

The general purpose of the present invention, which will be described subsequently in greater detail, is to provide a new Adjustable Boat Floor Insert apparatus and method which has many of the advantages of the boat flooring devices mentioned heretofore and many novel features that result in a new Adjustable Boat Floor Insert which is not anticipated, rendered obvious, suggested, or even implied by any of the prior art boat flooring devices, either alone or in any combination thereof.

To attain this, the present invention generally comprises a first floorboard member and a second floorboard member that is removably inserted into the first floorboard member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in, its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Adjustable Boat Floor Insert apparatus and method which has many of the advantages of the boat flooring devices mentioned heretofore and many novel features that result in a new Adjustable Boat Floor Insert which is not anticipated, rendered obvious, suggested, or even implied by any of the prior art boat flooring devices, either alone or in any combination thereof.

It is another object of the present invention to provide a new Adjustable Boat Floor Insert which may be easily and efficiently manufactured and marketed.

It is a further object of the present invention to provide a new Adjustable Boat Floor Insert which is of a durable and reliable construction.

An even further object of the present invention is to provide a new Adjustable Boat Floor Insert which is susceptible of a low cost of manufacture with regard to both materials and labor, and which accordingly is then susceptible of low prices of sale to the consuming public, thereby making such Adjustable Boat Floor Insert economically available to the buying public.

Still yet another object of the present invention is to provide a new Adjustable Boat Floor Insert which provides in the apparatuses and methods of the prior art some of the advantages thereof, while simultaneously overcoming some of the disadvantages normally associated therewith.

Still another object of the present invention is to provide a new Adjustable Boat Floor Insert for providing a level flooring surface for boats with a ribbed bottom.

Yet another object of the present invention is to provide a new Adjustable Boat Floor Insert which includes A first floorboard member and a second floorboard member that is removably inserted into the first floorboard member.

Still yet another object of the present invention is to provide a new Adjustable Boat Floor Insert that is adjustable to fit a variety of boat bottoms providing a one-size-fits-all design.

Even still another object of the present invention is to provide a new Adjustable Boat Floor Insert that allows a boat operator better able to move around in the boat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
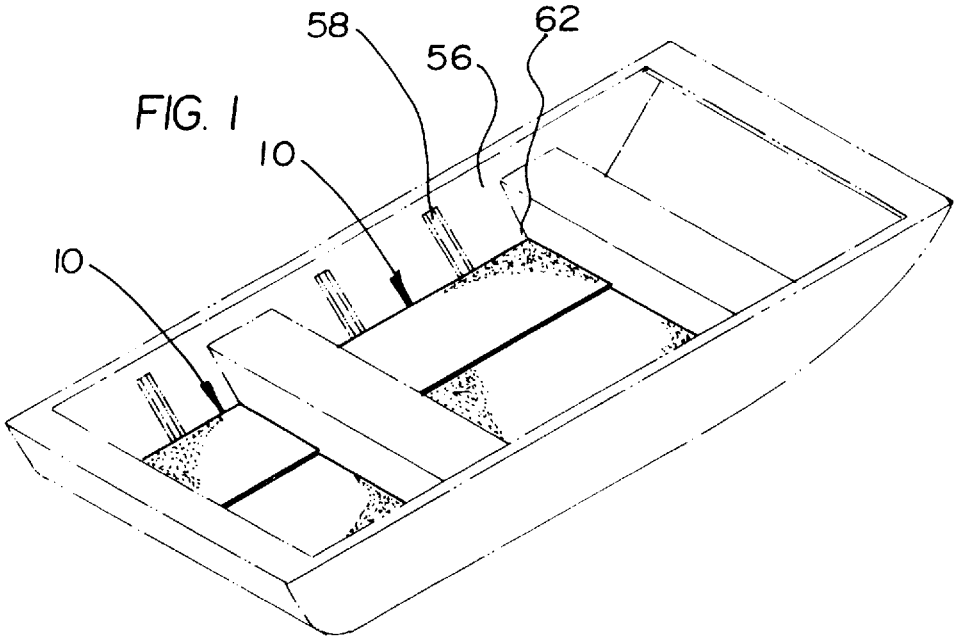
FIG. 1 is a right side perspective view of a new Adjustable Boat Floor Insert in a boat according to the present invention.
Figure 2:
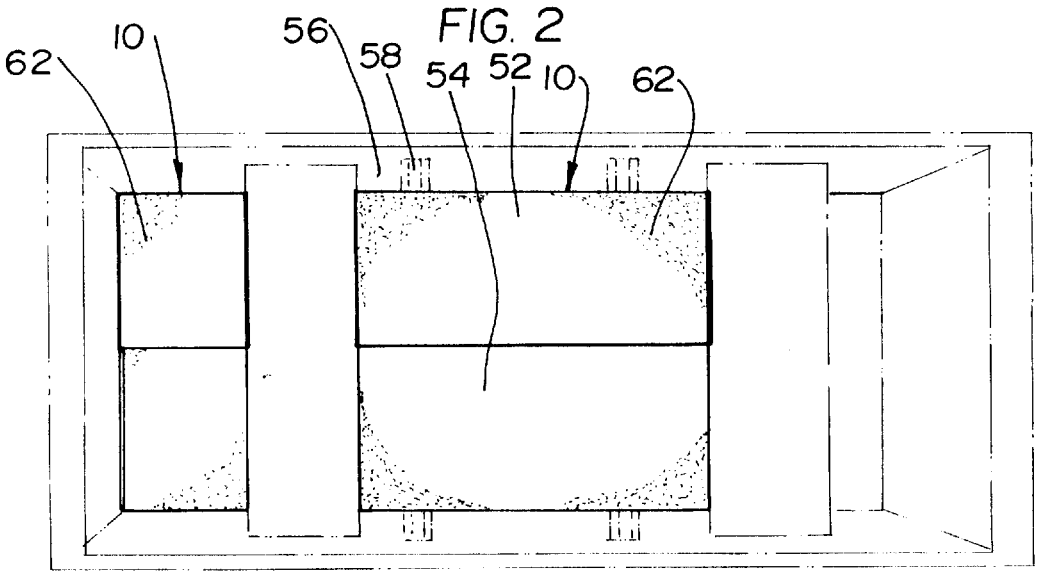
FIG. 2 is a top view of the Adjustable Boat Floor Insert in a boat on the exposed boat floor.
Figure 3:
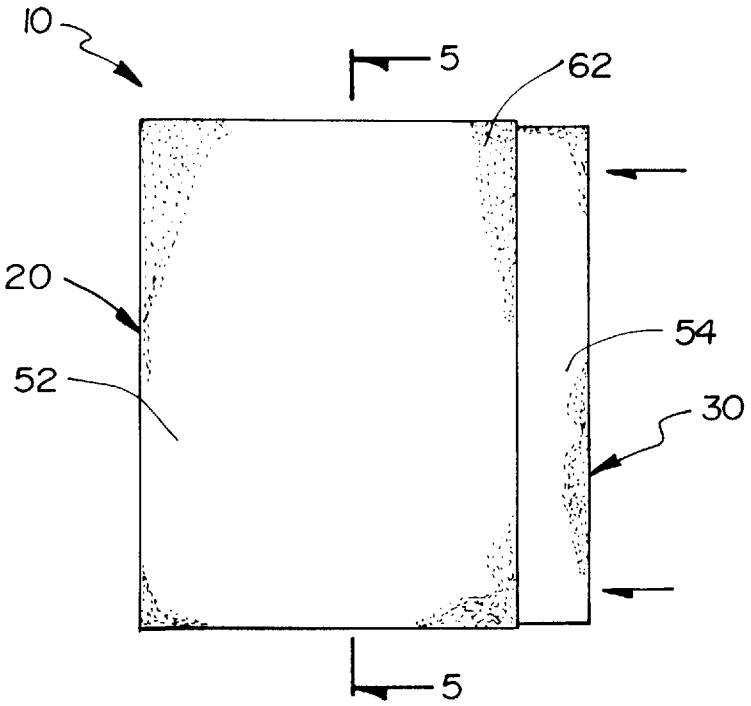
FIG. 3 is a top view of the Adjustable Boat Floor Insert showing the second floorboard member inserted in the first floorboard member.
Figure 4:
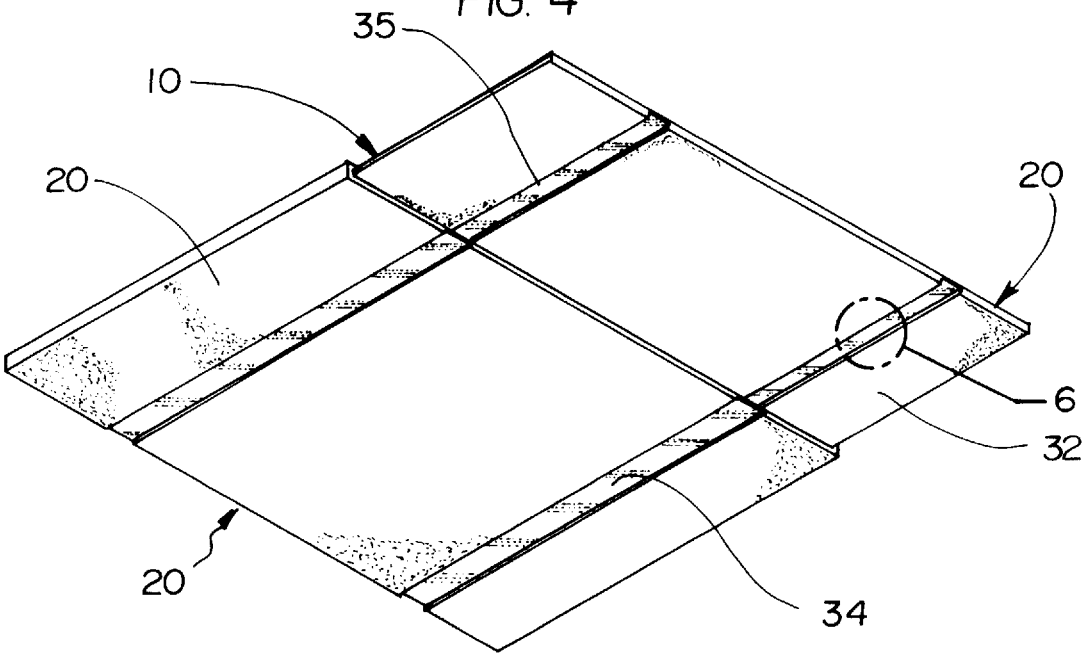
FIG. 4 is a bottom perspective view of the invention.
Figure 5:
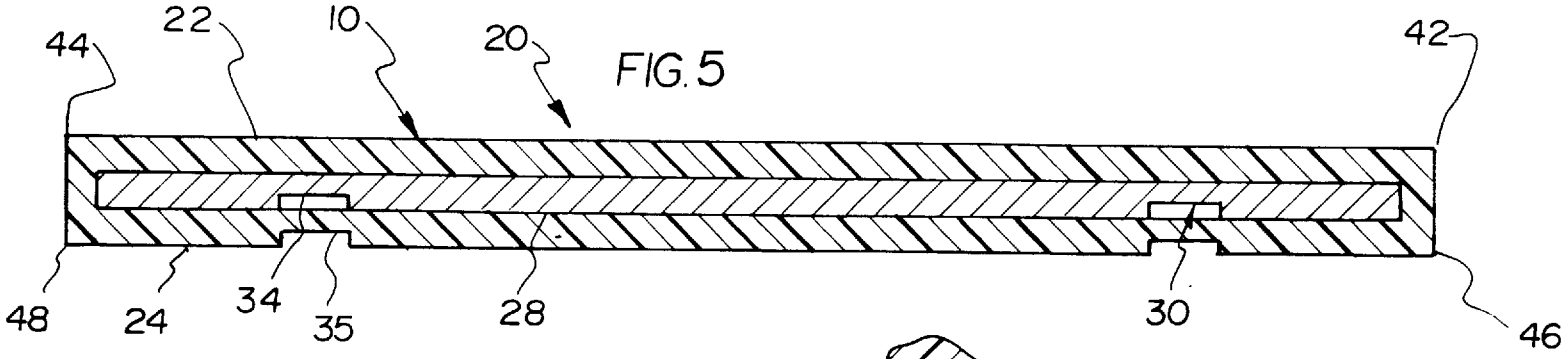
FIG. 5 is a cross sectional view taken along line 5—5 of FIG. 3.
Figure 6:
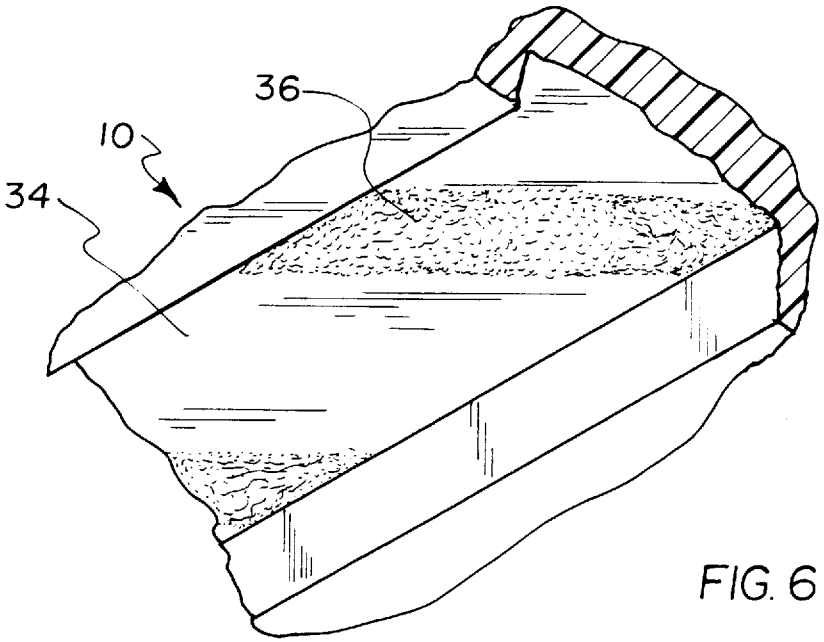
FIG. 6 is a perspective view of a broken away portion of the Adjustable Boat Floor Insert as indicated by circle 5 in FIG. 4.

With reference now to the drawings, and in particular to FIGS. 1 through 6 thereof, a new Adjustable Boat Floor Insert embodying the principles and concepts of the present invention and generally designated by the reference numeral 10 will be described.

More specifically, it will be noted that the Adjustable Boat Floor Insert 10 comprises a first floorboard member 20 defining a slot 28 and a second floorboard member 30.

As best illustrated in FIGS. 1 through 6, it can be shown that the first floorboard member 20 consists of a upper member 22 spaced apart from a lower member 24. The upper member 22 has a first upper periphery 42 and a second upper periphery 44. Similarly, the lower member 24 has a first lower periphery 46 and a second lower periphery 48. The first upper periphery 42 is attached to the first lower periphery 46 and the second upper periphery 44 is attached to the second lower periphery 48. The space between the upper member and the lower member defines a slot 28 that is large enough to accept the insertion of the second floorboard member 30. The second floorboard member 30 is inserted into the slot 28 in a similar orientation as the first floorboard member 20 to provide a somewhat rectangular shape to the Adjustable Boat Floor Insert 10.

The first floorboard member 20 and the second floorboard member 30 may optionally include draining holes to allow the water to drain off the Adjustable Boat Floor Insert 10. The top sides of the first floorboard member 20 and the second floorboard member 30, the first top side 52 and the second top side 54 respectively, may also be covered by an upper gripping surface 62 such as a roughened surface or a carpet to prevent users from slipping on the Adjustable Boat Floor Insert 10.

The bottom sides of the first floorboard member 20 and the second floorboard member 30, the first bottom side 26 and the second bottom side 32 respectively, have a series of grooves 34, 35 respectively, running laterally and aligned in the same orientation between the two floorboard members. The grooves 34, 35 are ideally slightly larger than the ribs of the boat floor where the Adjustable Boat Floor Insert 10 is to be used. When the Adjustable Boat Floor Insert 10 is placed on a boat floor 56, the bottom sides of floorboard members face down, these grooves 34, 35 are fitted over the ribs 58 of the boat. The grooves 34, 35 also include a rough grabbing surface 36 which help to frictionally hold the ribs 58 of the boat in the grooves 34, 35 providing greater stability to the Adjustable Boat Floor Insert 10.

In use, first floorboard member 20 and the second floorboard member 30 are slidably adjusted to fit the dimensions of the exposed boat floor 58 of a boat to be covered by the Adjustable Boat Floor Insert 10. The Adjustable Boat Floor Insert 10 is then placed on the exposed boat floor with the first bottom side 26 and the second bottom side 32 of the floorboard members face down. Optionally, these two steps may be reversed and the Adjustable Boat Floor Insert 10 may be first place on the boat floor 58 and then the first floorboard member 20 and the second floorboard member 30 slidably adjusted to fit the dimensions of the exposed boat floor 58. Lastly, for either option, the grooves 34, 35 are positioned and fitted over the ribs 58 of the boat floor 58 to prevent the Adjustable Boat Floor Insert 10 from sliding around in the boat.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable boat floor insert comprising:

a first substantially planar floorboard member;

a second substantially planar floorboard member; and said first floorboard member having a slot for receiving said second floorboard, said second floorboard being removably insertable into said slot such that said first floorboard member may be placed on the floor of a boat and second floorboard may be slidingly withdrawn from the slot of said first floorboard member to approximate the size of a boat floor.

2. An adjustable boat floor insert comprising:

a first floorboard member;

a second floorboard member;

said first floorboard member defining a slot therein in which said second floorboard is removably insertable for removably inserting said second floorboard member such that said first floorboard member may be placed on the floor of a boat and second floorboard may be slidingly withdrawn from the slot of said first floorboard member to approximate the size of a boat floor; and wherein said first floorboard member includes an upper member having a first and a second upper periphery and a lower member having a first and a second lower periphery, said upper member and said lower member being spaced apart and defining a slot therebetween, said first upper periphery being coupled to said first lower periphery, and said second upper periphery being coupled to said second lower periphery; and said second floorboard member being removably inserted into said slot.

3. An adjustable boat floor insert comprising:

a first floorboard member;

a second floorboard member;

said first floorboard member defining a slot therein in which said second floorboard is removably insertable for removably inserting said second floorboard member such that said first floorboard member may be placed on the floor of a boat and second floorboard may be slidingly withdrawn from the slot of said first floorboard member to approximate the size of a boat floor; and wherein said first floorboard member has a first bottom side with a plurality of grooves therein; said second floorboard member has a second bottom side with a plurality of grooves therein; and said grooves of said first bottom side being substantially aligned with said grooves of said second bottom side.

4. The adjustable boat floor insert of claim 3, wherein said grooves of said first bottom side and said grooves of said second bottom side include a rough grabbing surface therein.

5. The adjustable boat floor insert of claim 1, wherein said first floorboard member and said second floorboard member have a plurality of draining holes therein.

6. The adjustable boat floor insert of claim 1, wherein said first floorboard member has a first top side and said second floorboard member has a second top side, said first top side and said second top having a roughened surface.

7. The adjustable boat floor insert of claim 1, wherein said first floorboard member has a first top side and said second floorboard member has a second top side, said first top side and said second top being covered with a carpet.

8. The adjustable boat floor insert of claim 2, wherein said first floorboard member and said second floorboard member have a plurality of draining holes therein.

9. The adjustable boat floor insert of claim 2, wherein said first floorboard member has a first top side and said second floorboard member has a second top side, said first top side and said second top having a roughened surface.

10. The adjustable boat floor insert of claim 2, wherein said first floorboard member has a first top side and said second floorboard member has a second top side, said first top side and said second top being covered with a carpet.

11. The adjustable boat floor insert of claim 3, wherein said first floorboard member and said second floorboard member have a plurality of draining holes therein.

12. The adjustable boat floor insert of claim 3, wherein said first floorboard member has a first top side and said second floorboard member has a second top side, said first top side and said second top having a roughened surface.

13. The adjustable boat floor insert of claim 3, wherein said first floorboard member has a first top side and said second floorboard member has a second top side, said first top side and said second top being covered with a carpet.

14. The adjustable boat floor insert of claim 1, wherein said first floorboard member and said second floorboard member have a plurality of draining holes therein;

wherein said first floorboard member has a first top side and said second floorboard member has a second top side, said first top side and said second top having a roughened surface; and wherein said first floorboard member has a first top side and said second floorboard member has a second top side, said first top side and said second top being covered with a carpet.

* * * * *